United States Patent [19]

Deffayet et al.

[11] 4,408,538

[45] Oct. 11, 1983

[54] LAUNCHING MECHANISM FOR SUBCALIBRE PROJECTILE

[75] Inventors: Jean Deffayet; Etienne Lamarque, both of Paris, France

[73] Assignee: Thomson-Brandt, Paris, France

[21] Appl. No.: 350,657

[22] Filed: Feb. 22, 1982

Related U.S. Application Data

[63] Continuation of Ser. No. 107,681, Dec. 27, 1979, abandoned.

[30] Foreign Application Priority Data

Dec. 28, 1978 [FR] France ..... 78 36677

[51] Int. Cl.[3] ..... F42B 13/16

[52] U.S. Cl. ..... 102/522

[58] Field of Search ..... 102/520–523; 89/1.816–1.819

[56] References Cited

U.S. PATENT DOCUMENTS

| | | | |
|---|---|---|---|
| 2,669,930 | 2/1954 | Darby et al. | 102/523 |
| 2,998,780 | 9/1961 | Anspacher et al. . | |
| 4,015,528 | 4/1977 | Bar . | |
| 4,142,467 | 3/1979 | Stahlmann . | |

FOREIGN PATENT DOCUMENTS

| | | |
|---|---|---|
| 1262830 | 3/1968 | Fed. Rep. of Germany . |
| 1808779 | 6/1970 | Fed. Rep. of Germany . |
| 1090057 | 3/1955 | France . |
| 7705239 | 11/1978 | Netherlands . |
| 123501 | 2/1919 | United Kingdom . |

*Primary Examiner*—Harold J. Tudor
*Attorney, Agent, or Firm*—Edwin E. Greigg

[57] ABSTRACT

Launching mechanism for fine stabilized subcalibre projectile fired from a gun barrel having a smooth or rifled bore.

The mechanism comprises a sabot equipped with fork joints in which are articulated a set of jaws having means for articulation in rotation, bearing means in the gun barrel, means for holding the projectile constituted by bosses and spacers, locking means for the jaws and optionally aerodynamic means for unfolding the jaws.

The invention is applicable more particularly to projectiles for piercing armour plating.

9 Claims, 7 Drawing Figures

FIG_1-a
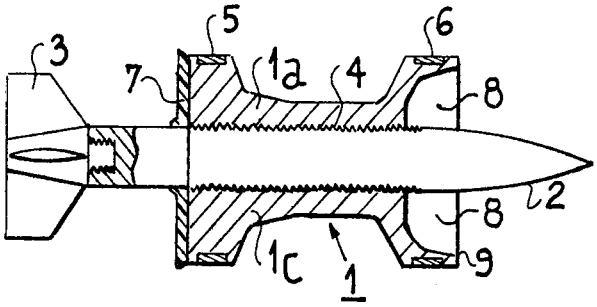
FIG_1-b
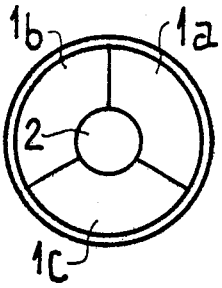
FIG_2
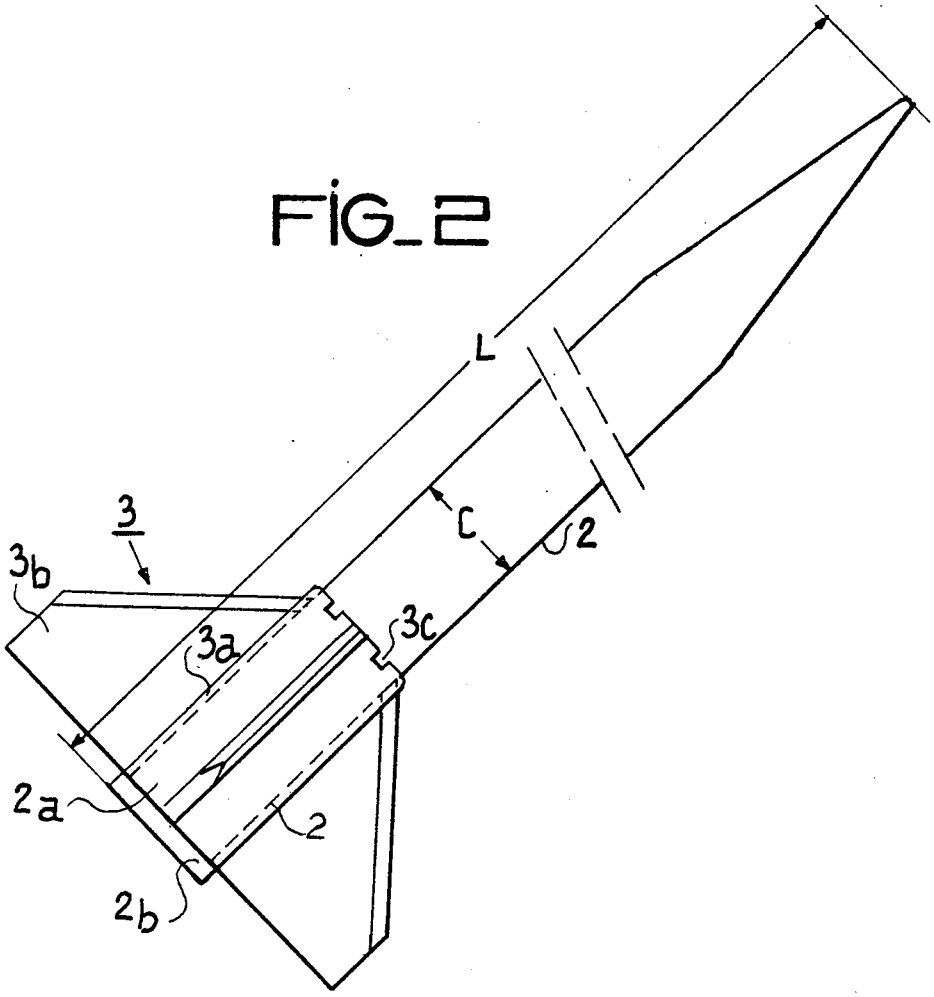

FIG_3-b
FIG_3-a
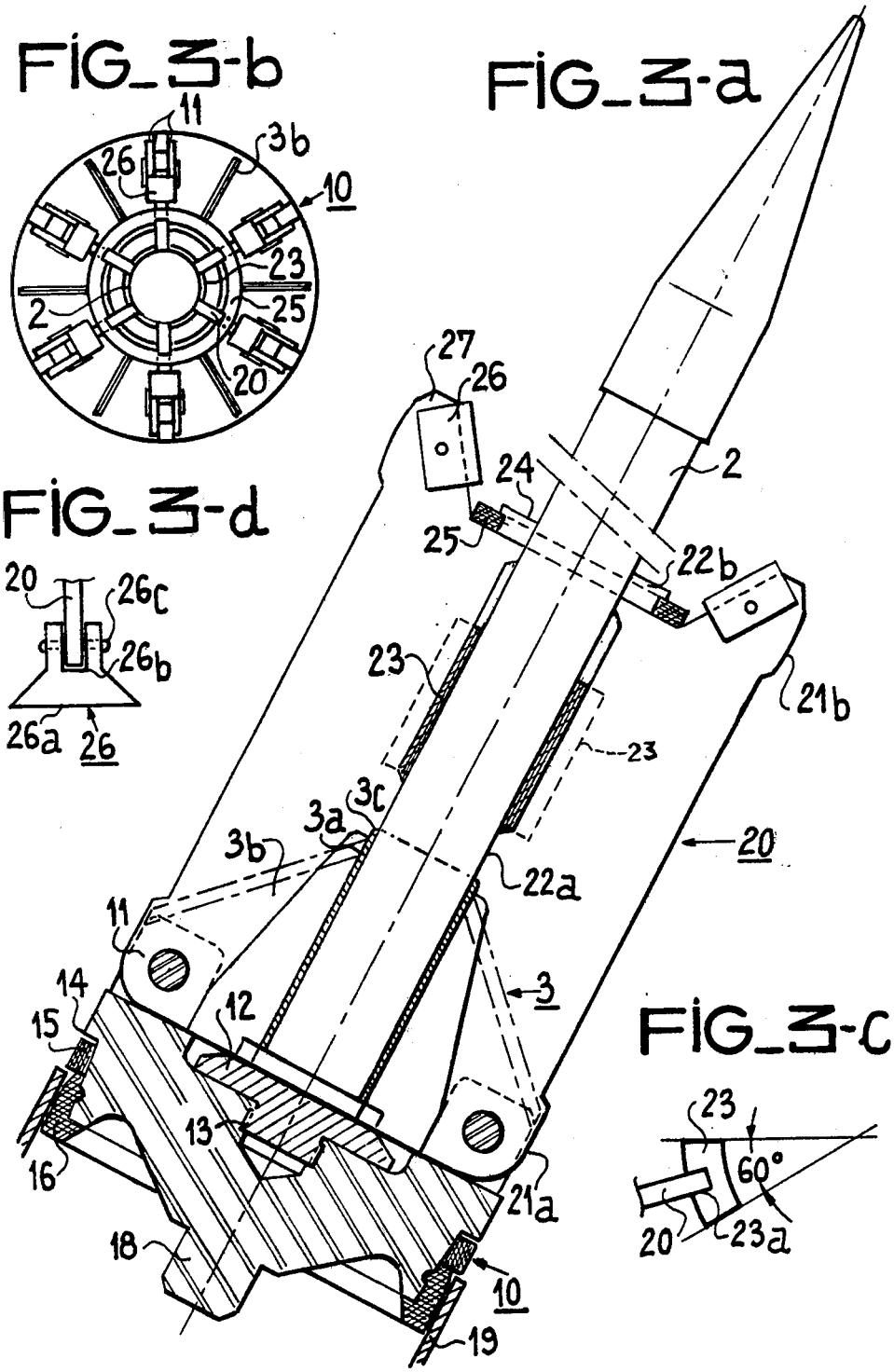
FIG_3-d
FIG_3-c

LAUNCHING MECHANISM FOR SUBCALIBRE PROJECTILE

This is a continuation of application Ser. No. 107,681, filed Dec. 27, 1979, now abandoned.

The invention relates to gun-fired projectiles and relates more specifically to a mechanism for launching a subcalibre projectile from a smooth or rifled bore gun barrel.

Despite the increasing importance attached to guided missiles, the gun remains the preferred armament on the tank, on the one hand because it is the armament system for short range combat at distances of about 2000 m and on the other hand as a result of the improvement (upgrading) of the gun projectiles due to the recent development of a new type of armor piercing projectile so-called "kinetic energy arrow", as compared with the piercing warhead hitherto used for the piercing of armour plating.

A armor piercing arrow is disclosed in U.S. Pat. No. 4,075,946 entitled to the Applicant Company. Armor piercing arrow has an length having an aspect ratio of approximately 10 to 20 diameter and is fitted with stabilizing fins, which may or may not be of the unfoldable type, located at the tail of the projectile body. With regard to the terminal ballistic phase, i.e. the armour plating piercing phase, it is obvious that said piercing power becomes more effective if the maximum of energy can be concentrated onto the minimum surface area. This explains the development of small diameter armour-piercing projectiles sped up by launching mechanism which fulfils a pressure intensifying function. In practice, the ratio of the calibres of the gun barrel and of the projectile is of the order to 3 to 5.

Launching mechanisms for firing subcaliber projectile in a smooth bore gun barrel with a diameter greater than that of the projectile calibre are already known. These launching mechanisms are rigidly linked with the projectile during the internal ballistic phase and the connection must be broken immediately on leaving the muzzle of the gun in order to rapidly release the projectile. The known launching mechanisms can be broken down into two categories, whereby the first sabots are used and in the second drive cages which, by opposition, drive or pull the projectile.

A sabot comprises a monolithic cylindrical member whose diameter is substantially the same as the diameter of the bore gun barrel and the projectile bears on the face of the sabot opposite to the propulsive gases. It is necessary to maintain the projectile in the axis of the gun barrel to prevent any initial obliqueness, which would be prejudicial to the accuracy of firing. It is also necessary to obviate oscillations of the projectile during the internal ballistic phase. To this end, key boxes have been proposed, which ensure the axial hold of the projectile to the detriment of a late separation of the system at the beginning of the trajectory.

It has also been proposed to assemble plastic material segments around the projectile body with the aim of ensuring a very good centering of the projectile, whilst retaining a rapid separation on leaving the muzzle. Finally, it has been proposed to use the fins of the projectile for fulfilling the centering function and simultaneously the guidance function, but there is often a deterioration of the aerodynamic stabilisation and flight drag characteristics.

A drive cage is arranged on the projectile body downstream of the fins and comprises the assembly of metal segments rigidly connected to the projectile body by known means such as grooves, notches, threads, etc. These segments have guidance means within the gun barrel, means for assembling the segments around the projectile and means for sealing the segments with respect to the propulsive gases. The major disadvantage of known drive cages is that at the time of separation, the segments pivot towards the rear and bear on the projectile body which has the effect of producing a not completely symmetrical mechanical momentum. Another disadvantage is the possible damage to the finned stabiliser which is then located in the propulsive gases. Finally, the means used for sealing the segments gives rise to constructional problems.

BRIEF SUMMARY OF THE INVENTION

The problem of the invention is to provide a launching mechanism for a fin stabilized subcalibre projectile making it possible to obtain a very small firing dispersion (i.e. high target exactness).

According to the invention, this problem is solved by a launching mechanism having a sabot equipped with a means for sealing with respect to the propulsive gases said sabot being made from a light alloy with a high mechanical strength and whereby it is provided in its central part with a steel disc on which bears the base of the projectile and on its periphery it is provided with fork joints (yokes) on which are articulated jaws which can open out radially, in flight, said jaws being constituted by rigid flat plates having a mechanical locking means during the assembly of the projectile and the launching mechanism, a mechanical means for guiding on the bore of the gun barrel, a mechanical means for centering the projectile in the axis of the gun barrel and optionally aerodynamic unfolding means of the jaws.

The advantages of the design proposed by the invention are firstly that the pivoting of the jaws does not act on the projectile body, but instead on the sabot and in addition the opening span of the jaws in the spread out position enables them to then be removed from the main gas flow of the gun, so that there is an effective air braking immediately on leaving the muzzle. Moreover, on complete opening, the impact of the jaws in the sabot leads to a breaking of contact between the sabot and the base of the projectile, which eliminates any perturbation on the latter. Finally, the very significant aerodynamic drag of the mechanism accelerates the separation process, so that the projectile placed under optimum conditions for obtaining a very limited firing dispersion.

BRIEF DESCRIPTION OF THE DRAWINGS

The invention is described in greater detail hereinafter relative to preferred, but non-limitative embodiments and with reference to the attached drawings, wherein:

FIGS. 1*a* and 1*b* illustrates a constructional embodiment of a drive cage for a fin stabilized projectile according to the prior art.

FIG. 2 illustrates a conventional armour piercing arrow with particular reference to the constructional details of the finned stabiliser.

FIG. 3*a* illustrates a longitudinal view of a constructional embodiment of a launching mechanism according to the invention.

FIG. 3*b* a front view of the launching mechanism of FIG. 3*a*.

FIG. 3*c* illustrates a sectional view of the constructional details of the plate holding spacers.

FIG. 3*d* illustrates a sectional view of the construction details of members making is possible to increase the opening out force of the jaws.

DETAILED DESCRIPTION OF THE PREFERRED EMBODIMENTS

FIGS. 1*a* and 1*b* which relate to the prior art show a drive cage 1 for a subcalibre projectile fitted with a finned stabiliser. The drive cage 1 comprises a plurality of segments, e.g. three segments 1*a*, 1*b* and 1*c*. These segments are rigidly connected to the missile body 2 equipped at its tail with a finned stabilizer 3 when the assembly is engaged in the not shown gun barrel by means of connecting means 4 constituted by grooves or threads. The segments are held together, respectively by at least one annular band 5 and optionally a band 6, said band simultaneously ensuring the guidance of the drive cage within the barrel. A sealing disk 7 is fixed to the rear of the drive cage. The mechanism functions in the following manner. As soon as the drive cage leaves the muzzle of the gun barrel, the pressure exerted on the rear prevents any release of the segments, release only taking place when the assembly is in a uniform flow indicated by arrows 8. The release is reinforced by the recess of the cavity 9. The segments then start to pivot to the right of disk 7, whilst bearing on the missile and then they swing freely giving a passage for the finned stabiliser with the risk of impact.

FIG. 2 partly shows a armour piercing arrow 2, i.e. the ratio of length L of calibre C exceeds ten. The cylindrical body of the projectile 2 is provided at the tail with a finned stabiliser 3 constituted by a circular member 3*a* on which are radially arranged fins 3*b*, there being four fins in the present case, but in practice there are often more such as six, as shown in FIG. 3*b*. The base 2*a* of the missile has a shoulder 2*b* for retaining stabiliser 3 in abutment. The circular member 3*a* can optionally have in accordance with the present invention notches 3*c* as shown in the front edge of circular member 3*a*, whose function will be described hereinafter. The span of stabilizer 3 can be significantly smaller than the gun barrel diameter. The projectile, which does not form part of the invention, and in particular the internal elements thereof will not be described.

FIGS. 3*a* and 3*b* respectively show in lateral view and in front view an embodiment of the launching mechanism according to the invention in which is secured a armour piercing projectile 2 equipped with a finned stabiliser 3 constituted by a circular member 3*a* on which are radially arranged six fixed fins 3*b*.

Excluding the pyrotechnic means the launching mechanism comprises a sabot 10 and a set of six jaws 20. FIG. 3*a* only shows two diametrically facing jaws. The sabot 10 is a circular member, whose external diameter is very slightly smaller than the calibre of the not shown gun barrel. The following members are arranged on the sabot face facing the base of the projectile: on the periphery six fork joints 11 in which are articulated the six jaws which can be radially spread out, in the central part a slightly frustum-shaped steel disc 12 on which the base of the missile abuts, said disc being maintained in the sabot by a thread 13, whilst the diameter of said steel disc 12 exceeds the diameter of the base and said disc functions as an anvil when firing the projectile. The profile of the sabot is such that on the one hand it resists the pressure of the propulsive gases and on the other the pressure of the projectile transmitted by the steel disc. The sabot has a circular peripheral shoulder 14 on which bears a sealing band 15 held by a compressed circular locking ring 16. In the present embodiment, the sabot has an axial protuberance 18 making it possible to receive the cartridge-holder edge, the casing 19 of said cartridge only being partly shown. The pyrotechnic propulsive means do not form part of the invention and will not be shown or described.

A jaw comprises a rigid flat plate 20 articulated in rotation in a fork joint (yoke) 11 of the sabot 10. A jaw has a set of means cooperating in the operation of the launching mechanism and constituted:

Means for the articulation in rotation of the plate in fork joint 11, said means comprising a hole traversed by a spindle supported by the fork joint or by any other known device.

Mechanical guiding means in the gun barrel, said means being constituted by bosses or protuberances arranged on the outer edge of the plate, e.g. two bosses 21*a* and 21*b* positioned at the ends of the plate.

Mechanical centering means for the projectile, said means being constituted by bosses arranged on the inner edge of the plate, e.g. two bosses 22*a* and 22*b* arranged respectively downstream of the circular member 3*a* and at the front end and on the other hand by a spacer 23 positioned between the above-mentioned bosses and preventing the lateral deformation of the plates.

Mechanical locking means for the jaws during the assembly of the projectile and the launching mechanism, said means being constituted by a notch 24 at the front of the plate and in which is placed a plastic ring 25 which is destroyed under the acceleration action.

Aerodynamic spreading-out means, if necessary, for increasing the opening force of the jaws and constituted by a planar member or spoiler 26, appropriately inclined towards the air flow direction, to which end there can be at the front of the plate a protuberance 27 in the form of a lip, whose outer edge can constitute the guiding boss 21*b*, whilst the inner part can be used for fixing the spoiler 26.

FIG. 3*c* shows constructional details of a spacer 23 for laterally maintaining the plates, said spacer being a circular segment of approximately 60° having a longitudinal groove 23*a* in which is embedded the plate 20. This spacer can be made from a material such as a light alloy.

FIG. 3*d* is a sectional view of a spoiler 26, having a planar surface 26*a* and a slot 26*b* permitting its connection to the plate 20. It can be held in place by a rivet 26*c* or a weld.

In order to ensure the centering of fins 3*b* of the projectile between adjacent jaws of the launching mechanism the circular member 3*a* of the finned stabiliser shown in FIG. 2 has notches 3*c* in which are freely engaged the rear edges of the plates 20.

The weight of the launching mechanism, particularly the sabot, must be minimised in order to give the missile the maximum initial velocity. To this end, the main elements of the mechanism, namely the sabot and the jaws, can be made from a high mechanical strenght light alloy, for example an alloy known under the name ZICRAL.

The sealing band can be made from a material such as SURLYN which is an ethylene isomer produced by the American company DUPONT de NEMOURS.

If it is desired to reduce the number of parts, whilst accepting a certain performance reduction, it is also possible to eliminate one out of two jaw. The jaws can be obtained directly by cutting, whilst their length must be sufficient on the one hand to reduce the oscillations of the projectile in the gun barrel and on the other, when spread-out must be largely free from the flow resulting from the propulsive gases of the gun.

The projectile launching mechanism assembly according to the invention functions as follows:

During the assembly period, the jaws of the launching mechanism equipped with the pyrotechnic propulsive means are half-open and the spacers 23 for holding the plates are fitted, after which the base 2*a* of the projectile is brought into engagement with the steel disc 12 and appropriately oriented to subsequently permit the engagement of the jaws in the slots 3*c* of the circular member 3*a* of finned stabiliser 3. The jaws are then closed onto the projectile and locked by introducing the plastic ring 25 into the notches 24.

During the firing phase, the assembly is located in the gun barrel and the cartridge ignited by one of the various known means, which leads to the speeding up thereof, whilst the projectile remains completely parallel to the axis of the gun and vibrations are reduced.

On leaving the muzzle, the aerodynamic force induced on the jaws brings about the almost instantaneous opening thereof without any risk of contact between the jaws and the projectile, which induces a shock on the sabot and increases the relative separation speed of the projectile base on the one hand and the steel disc of the sabot on the other. When completely opened out, the jaws offer the maximum resistance to advance, so that the launching mechanism is rapidly decelerated and drops in the immediate vicinity of the gun.

The launching mechanism described hereinbefore has been equipped with a armour piercing arrow with a calibre of the order of 20 mm and weighing approximately 1 kilogram. It has been fired experimentally in a gun with a calibre of approximately 80 mm. With accelerations greater than 50,000 g, the initial velocity is in the range 1000 m/s and the measured firing dispersions were significantly below 1 milliradian.

The advantages provided by the invention are now more readily apparent. The launching mechanism obviates any need for grooves on the projectile body, said grooves always being prejudicial to a greater or lesser extent to the mechanical strength of the projectile and to its aerodynamic properties. The opening out of the jaws not only fails to produce any harmful effect on the projectile, but also accelerates the separation process. The weight of the launching mechanism can be kept significantly below that of the projectile through the choice of the construction materials, whilst the finned stabiliser of the missile is perfectly protected from the propulsive gases of the gun.

The launching mechanism is not limited to the embodiment described hereinbefore and in particular the profile and the number of jaws can be modified. The shape, number and position of the guiding bosses on the barrel and the holding in place of the projectile can be varied. In addition, different materials can be used.

A launching mechansim according to the invention can be used in artillery and particularly for firing armour piercing subcaliber projectile.

We claim:

1. Launching mechanism for a finned subcalibre projectile to be fired from a gun barrel, said launching mechanism comprising a pusher sabot fitted with a folded projectile centering means that unfolds as said projectile leaves the gun barrel, characterized in that said folded projectile centering means comprises a plurality of rigid, thin, flat, radially extending and axially elongated blades paralleling a longitudinal axis of said projectile, pivot means pivotally supporting said blades on said sabot adjacent one end thereof for swinging movement from a folded position to an unfolded radially extending position as said projectile is launched, and retention means at the other end of said blades for securing said blades in their folded position prior to insertion in said gun barrel, said blades being configured to abut in folded position against said projectile and said gun barrel.

2. Launching mechanism according to claim 1, characterized in that the outer edges of said blades comprise bosses for abuting against the bore of the gun barrel.

3. Launching mechanism according to claim 1, characterized in that the inner edges of said blades comprise bosses for abuting against said projectile.

4. Launching mechanism according to claim 1, characterized in that said blades are fitted with transverse spacer members mounted on the inner edges of said blades for preventing lateral deformation of said blades.

5. Launching mechanism according to claim 1, comprising a destructible end locking ring secured on the front edge of said blades, and notches in said blades for anchoring said locking ring.

6. Launching mechanism according to claim 1 comprising fin centering means on said projectile body for centering the projectile fins between said axially elongated blades, said centering means including equally spaced notches in its forward end, characterized in that said fins are centered by the engagement of the inner edges of said axially elongated blades into said notches placed in said centering means on said projectile body.

7. Launching mechanism according to claim 6, characterized in that the notches are formed in the finned tail unit of the projectile.

8. A launching mechanism according to claim 1, characterized in that said sabot is made of light alloy having high mechanical strength and wherein the central portion of said sabot facing the base of said projectile is fitted with a steel disc.

9. A launching mechanism according to claim 1, characterized in that said sabot includes a face comprising an annular shoulder in which is placed a plastic sealing band for preventing escape of propellant gases.

* * * * *